US005234237A

United States Patent [19]

Gergoe et al.

[11] Patent Number: 5,234,237

[45] Date of Patent: Aug. 10, 1993

[54] MODULAR VAN DOOR LATCH

[75] Inventors: Bela Gergoe, Bloomfield; Joseph M. Osenkowski, Detroit, both of Mich.

[73] Assignee: General Motors Corporation, Detroit, Mich.

[21] Appl. No.: 881,276

[22] Filed: May 11, 1992

[51] Int. Cl.[5] ..... E05B 47/00

[52] U.S. Cl. ..... 292/201; 292/336.3; 292/DIG. 27

[58] Field of Search ..... 292/201, 216, 280, DIG. 25, 292/DIG. 26, DIG. 27, DIG. 46, DIG. 62, 336.3; 49/213

[56] References Cited

U.S. PATENT DOCUMENTS

| | | | |
|---|---|---|---|
| 3,608,941 | 9/1971 | Yokohama | 292/DIG. 26 X |
| 4,662,109 | 5/1987 | Yui et al. | 49/214 |
| 4,756,563 | 7/1988 | Garwood et al. | 292/216 |
| 4,775,176 | 10/1988 | Ikeda | 292/216 |

*Primary Examiner*—Richard E. Moore
*Attorney, Agent, or Firm*—Charles E. Leahy

[57] ABSTRACT

A modular latch assembly is disposed in a sliding van door for unlatching the van from a closed position and actuating a roller latch release so that the door can be moved from the fully open position. The latch assembly includes interior and exterior handles pivotally mounted relative to a mounting plate. The handles alternately engage and forcibly rotate a crank bar supported on the mounting plate. A motion transmitting core element extends from the crank bar to a rear latch supported on the door for controlling the rear latch. An interior lock button and an exterior lock cylinder move the crank bar into and out of operative engagement with the interior and exterior handles. The interior and exterior actuator handles also control a roller latch release mechanism supported on the mounting plate.

4 Claims, 3 Drawing Sheets

MODULAR VAN DOOR LATCH

TECHNICAL FIELD

The subject invention relates generally to a modular latch actuator assembly for actuating the rear latch mechanism of a sliding door for a vehicle.

BACKGROUND ART

Many van type vehicles are provided with a sliding door on the one side of the vehicle for convenient passenger entrance and egress. Such doors slide in a guided track between a closed position wherein the sliding door covers and seals against the opening provided in the van body, and an open position wherein the sliding door is moved away from the opening in the van body. A rear latch means is supported on the door adjacent its rearwardmost edge for latching the door in the closed position. An interior actuator handle movably extends from an interior surface of the door to actuate the rear latch means and thereby unlatch the door from the closed position. Similarly, an exterior actuator handle movably extends from the exterior surface of the door and is operative to unlatch the rear latch means to permit movement of the door from the closed position. A mechanism consisting of several push rod linkages extends from the respective handles to the rear latch means for controlling the rear latch means in response to movement inputs from the respective interior and exterior actuator handles. Further, a locking mechanism is provided so that, when engaged, the interior and exterior actuator handles are incapable of unlatching the door from the closed position. This is typically accomplished by providing an interior lock button and an exterior lock cylinder, each with corresponding push rod linkages extending to the rear latch means. In all, a typical van sliding door includes six to eight push rod linkages disposed therein for controlling the rear latch means, with each such linkage requiring individual installation, support and adjustment on the assembly line.

It will be readily appreciated that such construction adds to vehicle weight and expense for parts. Furthermore, the installation procedures necessary to string the various push rod linkages within the van door, along with the necessary length adjustments and installation of supporting and guiding structure, require time consuming and tedious operations which detracts from production efficiency and adds to vehicle costs.

The present invention answers to the above with new and improved construction which eliminates the push rod linkages and the difficulties and costs associated therewith and provides a straight forward light-weight and advanced latch actuator assembly for actuating the rear latch means of a sliding van door.

SUMMARY OF THE INVENTION AND ADVANTAGES

This invention provides a modular latch actuator assembly for actuating the rear latch mechanism of a sliding van door. The assembly comprises a door having an interior surface and an exterior surface, an interior actuator handle movably extending from the interior surface, and exterior actuator handle movably extending from the exterior surface, a rear latch means supported on the door and spaced from the interior and exterior actuator handles for latching the door in a closed position and unlatching the door from the closed position in response to a movement input from one of the interior and exterior actuator handles, and a motion transmitting means for transferring movements from the interior and exterior actuator handles to the rear latch means. This invention has new and improved isolator means for selectively and simultaneously disengaging both of the interior and exterior actuator handles from the motion transmitting means to prevent the transferring of motion from the interior and exterior actuator handles to the rear latch means to effectively lock the door in closed position.

The subject invention improves latch actuator assemblies for sliding doors for vehicles by the advanced isolator means which renders the interior and exterior actuator handles inoperative at their connection to the motion transmitting means. In contradistinction, the prior art renders the interior and exterior actuator handles inoperative at the rear latch means such that the motion transmitting means of the prior art remains operatively connected to the actuator handles at all times. According to the subject invention, however, the isolator means disconnects the motion transmitting means from the actuator handles so that while the isolator means is engaged, the interior and exterior actuator handles may be moved without transmitting motion to the motion transmitting means. Thus, with the motion transmitting means remaining stationary while the isolator means is engaged, the rear latch means will not receive a movement input and thus will not unlatch the door from the closed position.

A further advantage of the subject latch actuator assembly is that at least one of the actuator handles and the isolator means may be incorporated as a modular unit which is quickly and easily installed in the van door. Also, the motion transmitting means may be highly simplified from the prior art push rod linkages so that only one single motion transmitting element extends between the isolator means and the rear latch means.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
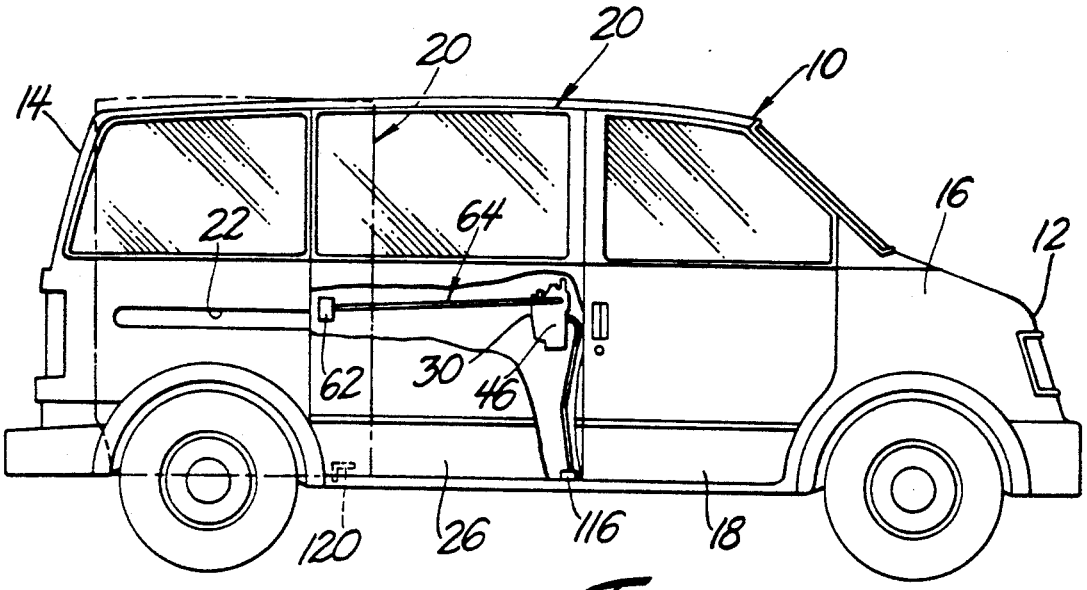
FIG. 1 is a simplified side view of a vehicular passenger van having a sliding door partially broken away to reveal the modular latch actuator assembly of the subject invention.

Referring to the Figures, wherein like numerals indicate like or corresponding parts throughout the several views, a passenger van is generally indicated at 10 in FIG. 1. The van 10 includes a forward end 12 and a rearward end 14. A passenger side 16 of the van 10 is provided with a front passenger door 18 and a rear sliding cargo door, generally indicated at 20. A sliding door 20 is supported in the van 10 in a typical manner, i.e., upon guided roller tracks. The sliding door 20 is shown in solid in FIG. 1 in a closed position wherein the opening provided in the passenger side 16 for the door 20 is completely closed. The door 20 is shown in phantom in an open position. A portion of the guided roller track for the door 20, exterior of the van 10, is indicated as 22 in FIG. 1. The door 20 includes an interior surface 24 presented toward the interior passenger compartment of the van 10, and an exterior surface 26 facing outwardly from the van 10.

An interior actuator handle 28 movably extends from the interior surface 24 of the door 20 and is supported directly upon a mounting plate 30 disposed within the door 20. The interior actuator handle 28 is mounted for pivotal movement about a substantially vertical axis, with a torsion spring 32 interacting between the interior actuator handle 28 and the mounting plate 30 to provide return movement to a central free state position. In this manner, the interior actuator handle 28 may be moved about its vertical axis either forwardly or rearwardly for limited arcuate distances, with the torsion spring 32 returning the interior actuator handle 28 to a neutral central position each time.

An upper slug 34 and a lower slug 36 extend rearwardly from the interior actuator handle 28 on opposite ends of the torsion spring 32. An upper finger 38 is pivotally supported about the axis of the interior actuator handle 28 and includes a U-shaped slug receiving portion 40 which engages the forward edge of the upper slug 34 so that when the interior actuator handle 28 is pivoted rearwardly, thus displacing the upper slug 34 forwardly, the upper finger 38 is carried with the upper slug 34 and thus pivoted in the forward direction. Because the torsion spring 32 engages the upper finger 38 adjacent the slug receiving portion 40, when pressure on the interior actuator handle 28 is released, the upper finger 28 is returned to the central position. However, when the interior actuator handle 28 is pivoted forwardly, thus displacing the upper slug 34 rearwardly, the upper finger 38 remains stationary, i.e., in the central position, as the upper slug 34 simply moves out of the slug receiving portion 40.

The interior actuator handle 28 also includes a lower finger 42 pivotally disposed about the vertical axis of the interior actuator handle 28 yet partially independent of the movement thereof. The lower finger 42 includes a generally U-shaped slug receiving portion 44 which engages the rearward edge of the lower slug 36. In this manner, when the interior actuator handle 28 is pivoted forwardly, thus displacing the lower slug 36 rearwardly, the lower finger 42 is moved with the lower slug 36. However, when the interior actuator handle 28 is moved rearwardly, the forwardly moving lower slug 36 slides out of the slug receiving portion 44 of the lower finger 42 thereby maintaining the lower finger 42 in the central position.

An exterior actuator handle 46 is also pivotally mounted for movement about a substantially vertical axis. The exterior actuator handle 46 is structured in very much the same manner as the interior actuator handle 28 described above, with a torsion spring 48, an upper slug 50 and lower slug 52. An upper finger 54 includes a slug receiving portion which engages the rearward side of the upper slug 50 so that when the exterior actuator handle 46 is pivoted forwardly, the rearwardly moving upper slug 50 carries with it the upper finger 54. However, when the exterior actuator handle 46 is pivoted rearwardly, the forwardly moving upper slug 50 merely moves out of the slug receiving portion of the upper finger 54. Also, a lower finger 58 is provided with a slug receiving portion engaging the forwardmost edge of the lower slug 52. In this manner, when the exterior actuator handle 46 is pivoted rearwardly, the forwardly moving lower slug 52 engages the lower finger 58 to pivot the lower finger 58 forwardly. However, when the exterior actuator handle 46 moves forwardly, the lower slug 52 merely moves out of the slug receiving portion of the lower finger 58, thereby leaving the lower finger 58 in the central position.

Referring again to FIG. 1, a rear latch means 62 is shown disposed inside the sliding cargo door 20 adjacent its rearmost edge. The rear latch means 62 is spaced from the interior 28 and exterior 46 actuator handles and latches the door 20 in a closed position and alternately unlatches the door 20 from the closed position in response to a movement input from one of the interior 28 and exterior 46 actuator handles. That is, pivotal movement of the interior 28 and exterior 46 handles described above is effective to control, or actuate, the rear latch means 62 such that the door 20 can be unlatched from the closed position and thence moved manually to an open position, as shown in phantom in FIG. 1. The rear latch means 62 is of a generally conventional type including a mechanism (not shown) which engages a portion of the van sidewall adjacent the rearward most edge of the door 20 to securely fasten the door 20 in the closed position.

A motion transmitting means, generally indicated at 64 in FIG. 1, is provided for transferring movements from the interior 28 and exterior 46 actuator handles to the rear latch means 62. In other words, due to the remote nature of the interior 28 and exterior 46 actuator handles from the rear latch means 62, the motion transmitting means 46 extends between the three members and is effective to conduct, or transmit, the movements from the interior 28 and exterior 46 actuator handles to the rear latch means 62 for the purpose of unlatching the door 20 from the closed position. In the preferred embodiment illustrated in the Figures, the motion transmitting means 64 includes a flexible supporting conduit 66 disposed within the door 20 and supported at various points along its length in typical fashion. A flexible motion transmitting core element 68 is slidably disposed or supported in the conduit 66 and operatively connects the interior 28 and exterior 46 actuator handles with the rear latch means 62. Thus, when either of the interior 28 or exterior 46 actuator handles are pivoted, such pivotal motion is transferred to the core element 68 which slides within the stationary conduit 66 and thereby actuates the rear latch means 62 to unlatch the door 20 from the closed position.

Figure 4:
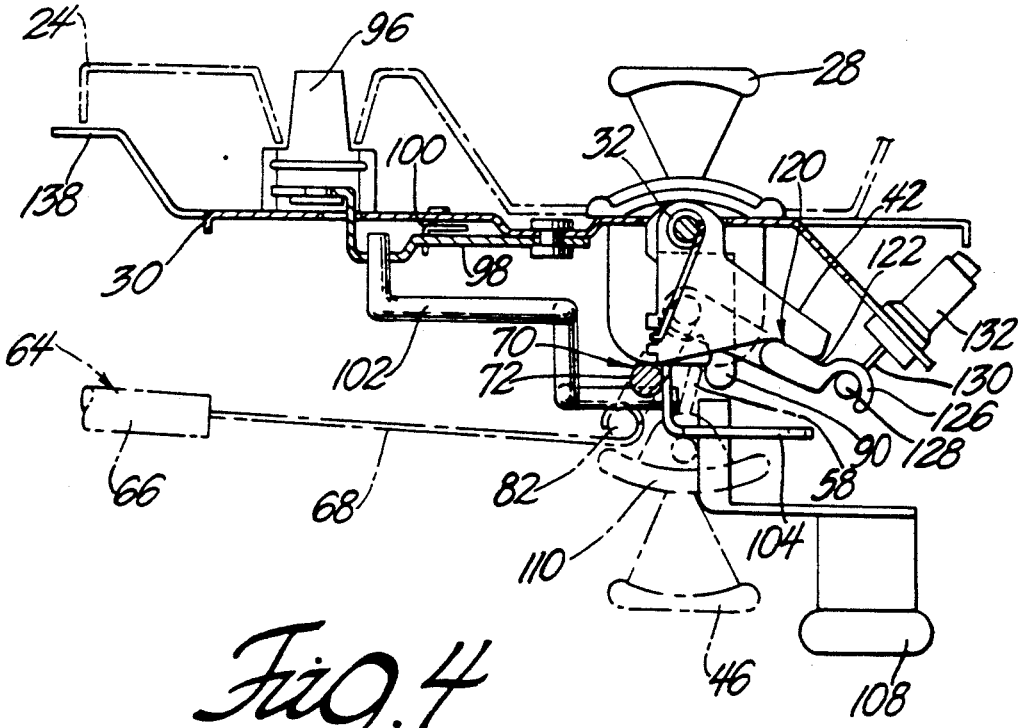
FIG. 4 is a cross-sectional view taken substantially along lines 4—4 of FIG. 2.
Figure 2:
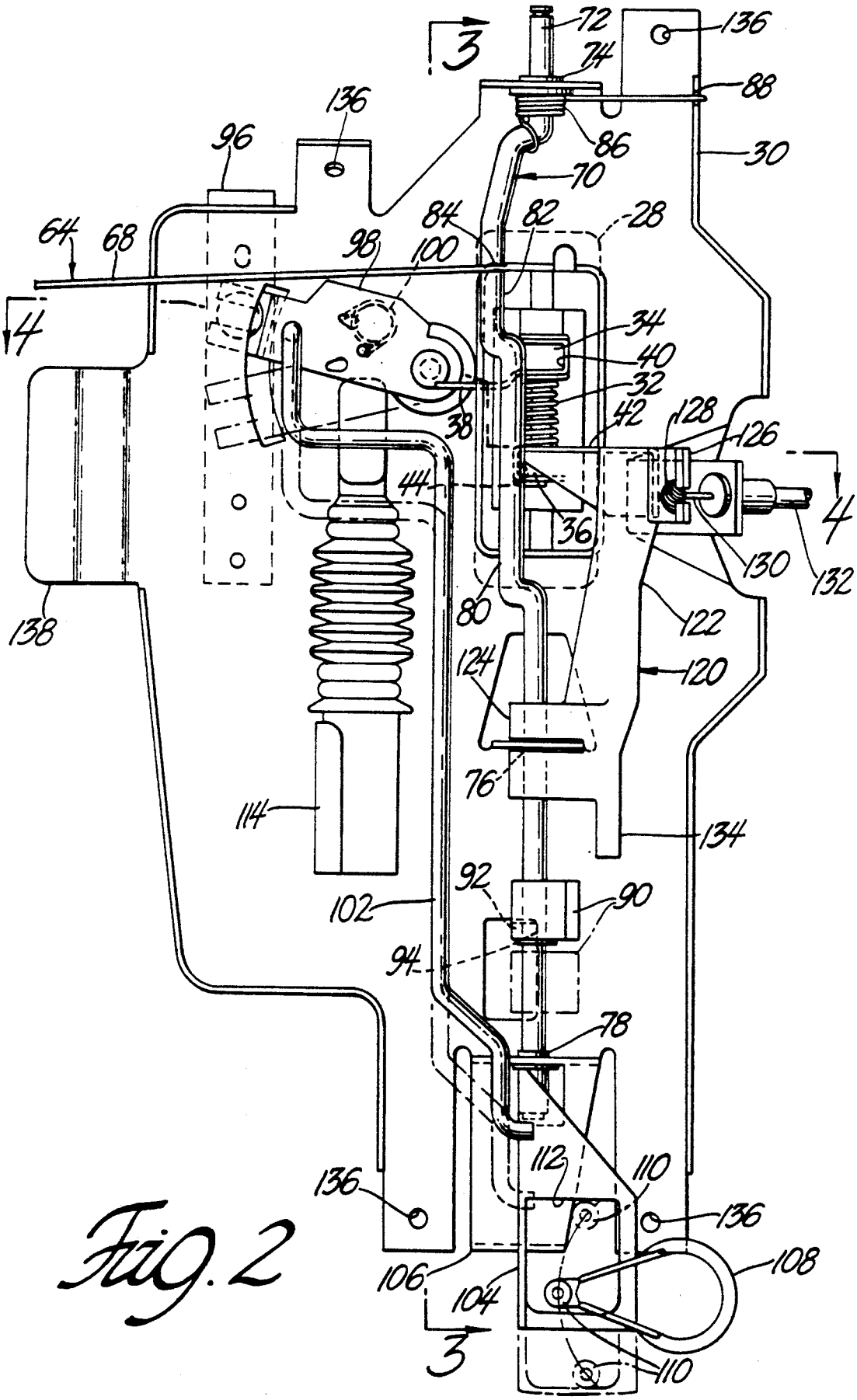
FIG. 2 is a front view of the modular latch actuator assembly.
Figure 3:
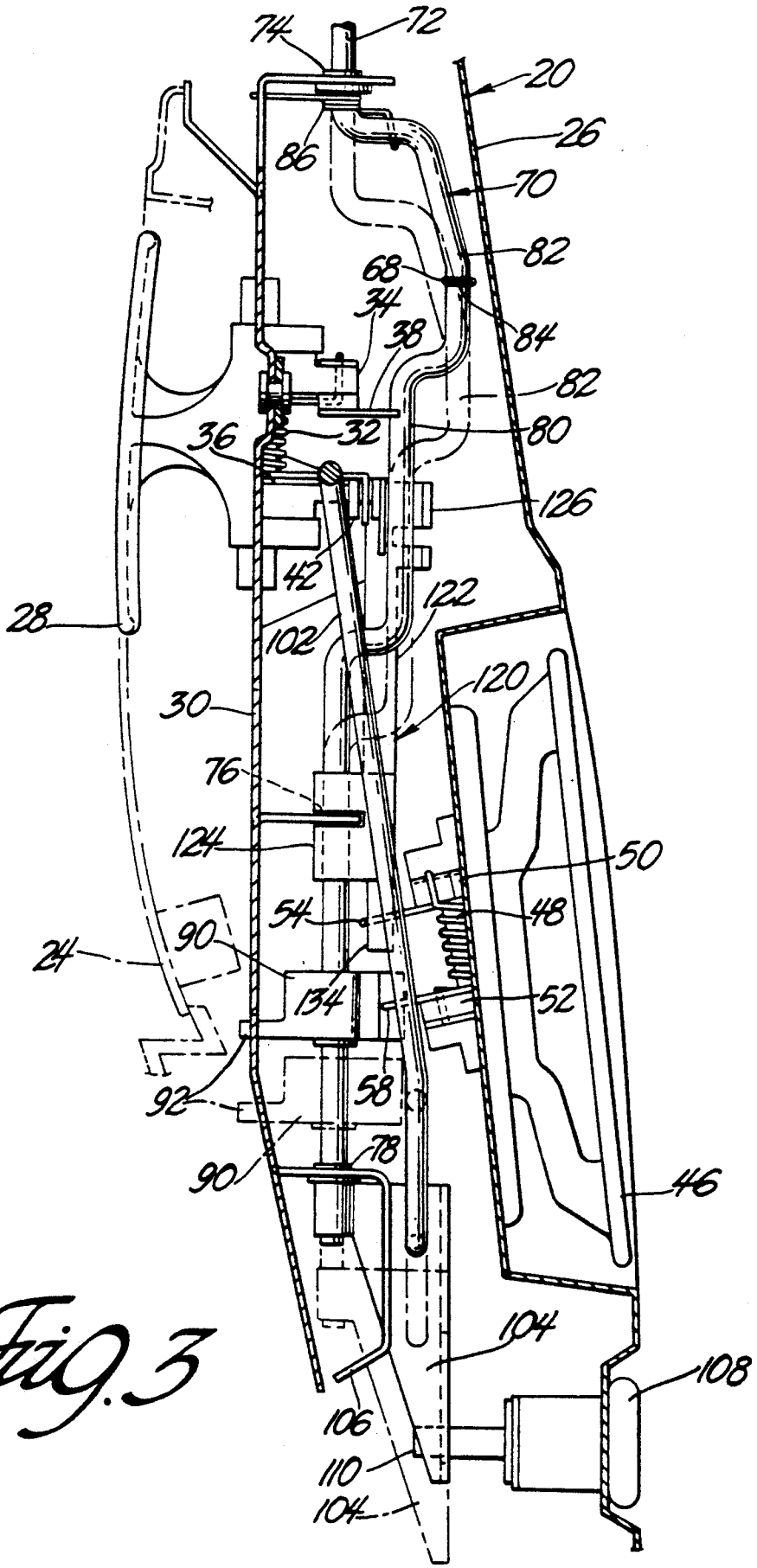
FIG. 3 is a cross-sectional view taken generally along lines 3—3 of FIG. 2.

The subject assembly further includes an isolator means, generally indicated at 70 in FIGS. 2 through 4, for selectively and simultaneously disengaging both of the interior 28 and exterior 46 actuator handles from the motion transmitting means 64 to prevent the transferring of motion from the interior 28 and exterior 46 actuator handles to the rear latch means 62 to effectively lock the door 20 in the closed position. That is, the isolator means 70 comprises the locking structure for securing the door 20 in the closed position. The isolator means 70 is disposed between the core element 68 and the interior 28 and exterior 46 actuator handles so as to permit the transmission of forces from the interior 28 and exterior 46 actuator handles when the isolator means 70 is disengaged, and alternatively preventing the transfer of motion from interior 28 and exterior 46 actuator handles when the isolator means 70 is engaged. Thus, the isolator means 70 effectively locks the door 20 in the closed position by neutralizing the interior 28 and exterior 46 actuator handles so that the respective handles are free to move, yet are ineffective to transfer motion via the core element 68 to actuate the rear latch means 62.

As best shown in FIGS. 2 and 3, the isolator means 70 includes a crank bar 72 pivotally supported within the door 20 upon the mounting plate 30 and operatively interconnecting the core element 68 with each of the interior 28 and exterior 46 actuator handles. More particularly, the mounting plate 30 includes three tab-like projections each having a hole therein for respectively receiving an upper bushing 74, a central bushing 76 and a lower bushing 78. The crank bar 72 is formed of a generally cylindrical rod-like member pivotally received and supported in each of the bushings 74, 76, 78. The bushings 74, 76, 78 may be fabricated from a brass or bronze material, whereas the mounting plate 30 is typically a stamped steel product.

The crank bar 72 is provided with an offset interior crank arm 80 formed integrally from the crank bar 72 between the upper bushing 74 and the central bushing 76. The interior crank arm 80 is structured so as to engage the upper finger 38 of the interior actuator handle 28 upon movement thereof. A crank bypass 82 extends from the interior arm 80 and is bent further radially outwardly therefrom between the interior crank arm 80 and the upper bushing 74. An annular groove 84 is provided in the crank bypass 82 for attaching an end of the core element 68. A torsion-type return spring 86 surrounds the crank bar 72 and reacts between the crank bypass 82 and a V-notch 88 in the mounting plate 30.

The crank bar 72 further includes an exterior crank pad 90 surrounding the crank bar 72 and secured thereto by a set screw (not shown) engaging a flat (not shown) on the crank bar 72. The exterior crank pad 90 is positioned between the central bushing 76 and the lower bushing 78 and disposed for engaging the lower finger 58 of the exterior actuator handle 46. The exterior crank pad 90 includes a stop member 92, best shown in FIG. 3, for engaging an abutment 94 in the mounting plate 30 formed by a vertically elongated rectangular opening in the mounting plate 30. Thus, as viewed from FIG. 4, the return spring 86 urges the crank bar 72 to rotate in a clockwise direction about its axis defined by the bushings 74, 76, 78, until the stop member 92 of the exterior crank pad 90 engages the abutment 94 to hold the crank bar 72 in the position shown in FIGS. 2 through 4.

The isolator means 70 is shown in the disengaged position in solid in FIGS. 2 and 3, with the interior crank arm 80 positioned to engage the upper finger 38 of the interior actuator handle 28, and the exterior crank pad 90 positioned to engage the lower finger 58 of the exterior actuator handle 46. Thus, if an operator chooses to unlatch the rear latch 62 from inside the van 10, the interior actuator handle 28 is pivoted rearwardly, thus displacing the upper finger 38 against the interior crank arm 80, and thereby rotating the interior crank arm 80 in a forward direction. This places the core elements 68 in tension and draws the core element 68 with the moving crank bypass 82 to unlatch the rear latch means 62 and permit the door 20 to be moved from the closed position. Similarly, if an operator chooses to open the door 20 from the exterior of the van 10, the exterior actuator handle 46 is pivoted rearwardly, thus displacing the lower finger 58 in a forward direction, and carrying with it the exterior crank pad 90 to cause a forward movement of the crank bypass 82, thereby drawing the core element 68 in tension with the crank bypass 82 to unlatch the rear latch means 62.

Two mechanisms are provided to move the isolator means 70 from the disengaged position described above, to the engaged position wherein the interior 28 and the exterior 46 actuator handles are neutralized from actuating the rear latch means 62. This engaged position is shown in phantom in FIGS. 2 and 3 and is marked by a laterally downward shift of the crank bar 72. One such mechanism for accomplishing this is an interior lock button 96 movably extending from the interior surface 24 of the door 20 and operatively connected to the crank bar 72 to move the crank bar 72 out of operative engagement with the interior 28 and exterior 46 actuator handles, as shown in FIGS. 2 and 4. More particularly, the interior lock button 96 is supported in a sliding track upon the mounting plate 30 and is presented within the interior of the van 10 for manual actuation by an occupant between an upper position wherein the isolator means 70 is in the disengaged position as described above, and a downward position wherein the isolator means 70 is moved to the engaged position.

The interior lock button 96 is connected to a lever 98 pivotally secured to the mounting plate 30, as illustrated in FIG. 2. A counter balance spring 100 reacts between the lever 98 and the mounting plate 30. A crank isolator rod 102 extends from the lever 98 and is displaced vertically by movement of the interior lock button 96. The crank isolator rod 102 is connected at its lowermost end to a connector plate 104 and secured to the lowermost end of the crank bar 72 such that vertical sliding movement of the connector plate 104 causes a corresponding vertical sliding movement of the crank bar 72, however rotational movement of the crank bar 72 is not imparted to connecter plate 104. An anti-rotational guide structure 106 is formed integrally with the mounting plate 30 to prevent rotation of the connector plate 104 with the crank bar 72 yet permit free vertical sliding movement of the connector plate 104 and the crank bar 72. Thus, as the interior lock button 96 is displaced vertically, pivotal movement of the lever 98 causes the crank isolator rod 102 to shift vertically up and down, which motion is correspondingly imparted to the crank bar 72 via the connector plate 104.

Additionally, the isolator means 70 is moved between the engaged and disengaged positions from the exterior of the van 10 by an exterior lock cylinder 108 movably extending from the exterior surface 26 of the door 20 and operatively connected to the crank bar 72 to move the crank bar 72 out of operative engagement with the interior 28 and exterior 46 actuator handles. More specifically, the exterior lock cylinder 108 is supported upon the door 20 directly and is structured to receive the typical key used to lock and unlock the vehicular doors and to operate the ignition. Thus, when the key is inserted into the exterior lock cylinder 108 and rotated, a throw 110 located on the rearward side of the exterior lock cylinder 108 is displaced either clockwise or counterclockwise to either unlock or lock the door 20. As shown in FIG. 2, when in the free state position, the throw 110 is disposed generally horizontally and radially from the exterior lock cylinder 108.

The end of the throw 110 is operatively received in a large rectangular opening 112. The opening 112 forms a lost motion fitting between the connector plate 104 and the throw 110 so that the crank bar 72 may be shifted vertically between its engaged and disengaged positions while the exterior lock cylinder 108 and throw 110 remain in the free state position as shown in solid. However, the exterior lock cylinder 108 is operable to shift the crank bar 72 from the engaged to the disengaged position, or alternately from the disengaged to the engaged position by forcibly urging the connecter plate 104 in a desired direction which causes a simultaneous shift in the crank bar 72. Because the crank isolator rod 102 is connected to the connecter plate 104, shifting of the crank bar 72 by the exterior lock cylinder 108 carries with it the crank isolator rod 102, the lever 98 and the interior lock button 96.

A power lock actuator 114 may be connected to the crank isolator rod 102 midway between the lever 98 and the connecter plate 104 to shift the crank bar 72 between its engaged and disengaged positions. In typical fashion, the power lock actuator 114 comprises a solenoid type motor electrically powered by the electrical system in the van 10 and remotely actuated by any one of several switches located strategically throughout the passenger compartment of the van 10.

As is typical with most van sliding cargo doors, a roller is provided adjacent the bottom edge of the door 20 adjacent its forward end. The roller (not shown) is guided in a track (not shown) for controlling the sliding movement of the door 20 between the open and closed positions. As shown in FIG. 1, a roller latch 116 is provided adjacent the roller for engaging a catch 118 when the door 20 is in the open position, shown in phantom in FIG. 1. The roller latch 116 holds the door 20 in this open position until either of the interior 28 or exterior 46 actuator handles are manipulated to release the door 20 from the open position.

A roller latch release means, generally indicated at 120 in FIGS. 2–4, is pivotally supported on the mounting plate 30 and operatively connected to each of the interior 28 and exterior 46 actuator handles independently of the crank bar 72 for releasing the remote roller latch 116 upon actuation of one of the interior 28 and exterior 46 actuator handles. The roller latch release means 120 includes a roller latch control lever 122 pivotally supported on the crank bar 72 yet fully independent of the movement of the crank bar 72. The control lever 122 includes a yoke member 124 which straddles the central bushing 76 thereby restraining axial movement of the control lever 122 against the crank bar 72. A cup 126 extends from the control lever 122 for receiving the slug 128 of a core element 130. The core element 130 is slidably supported in a conduit 132 supported within the door 20 and extends downwardly toward the roller latch 116. The lowermost end of the core 130 is operatively connected to the roller latch 116 so that movement of the cup 126 is transferred directly to the core element 130 thereby displacing the core element 130 and releasing the roller latch 116.

As best shown in FIGS. 2 and 4, the lower finger 42 of the interior actuator handle 28 engages the control lever 122 so that forward pivotal movement of the interior actuator handle 28 is conducted through the lower finger 42 to the control lever 122, thus displacing the cup 126 in a clockwise direction (viewed from FIG. 4) about the crank bar 72 to release the roller latch 116.

The control lever 122 includes an appendage 134 disposed for engaging the upper finger 54 of the exterior actuator handle 46. In this manner, when the exterior actuator handle 46 is pivoted in a forward direction, the upper finger 54 engages the appendage 134 and pivots the control lever 122 in a clockwise direction (viewed from FIG. 4) about the crank bar 72 thereby displacing the cup 126 and core element 130 to release the roller latch 116. Because the control lever 122 is restrained from axial sliding movement with the crank bar 72, the roller latch release means 120 remains operatively connected with the interior 28 and exterior 46 actuator handles at all times, i.e., independent of the engaged/-disengaged position of the isolator means 70.

The subject modular latch actuator assembly overcomes the disadvantages of the prior art in that all of the major components except the exterior lock cylinder 108 and exterior actuator handle 46 are supported directly on the mounting plate, which mounting plate 30 can be quickly installed in the sliding cargo door 20 on the assembly line. For this purpose, a plurality of mounting holes 136 are provided in the mounting plate 30 to receive fasteners (not shown) and a tab portion 138 extends from one side of the mounting plate 30 for connecting the assembly inside the door 20. Also, the unique isolator means 70 eliminates the prior art need for a plethora of push rod elements extending between the interior lock button 96 and the exterior lock 108 and the rear latch means 62, all of which requiring individual installation, support and adjustment on the assembly line. Instead, the isolator means 70 efficiently, compactly and simply neutralizes the interior 28 and exterior 46 actuator handles from the core element 68 to lock the door 20 in the closed position.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

We claim:

1. A modular latch actuator assembly for actuating the rear latch mechanism of a sliding van door, said assembly comprising:

a door having an interior surface and an exterior surface;

an interior actuator handle movably extending from said interior surface;

an exterior actuator handle movably extending from said exterior surface;

rear latch means supported on said door and spaced from said interior and exterior actuator handle for latching said door in a closed position and unlatching said door from the closed position in response to a movement input from one of said interior and exterior actuator handles;

a conduit disposed in said door;

a flexible motion transmitting core element slidably supported in said conduit and operatively connecting said rear latch means;

isolator means for selectively and simultaneously disengaging both of said interior and exterior actuator handles from said core element to prevent the transferring of motion from said interior and exterior actuator handles to said rear latch means to effectively lock said door into closed position; and said isolator means including a crank bar pivotally supported in said door and operatively interconnecting said core element with each of said interior and exterior actuator handles.

2. A modular latch actuator assembly for actuating the rear latch mechanism of a sliding van door, said assembly comprising:

a door having an interior surface and an exterior surface;

an interior actuator handle movably extending from said interior surface;

an exterior actuator handle movably extending from said exterior surface;

rear latch means supported on said door and spaced from said interior and exterior actuator handles for latching said door in a closed position and unlatching said door from the closed position in response to a movement input from one of said interior and exterior actuator handles;

a conduit disposed in said door;

a flexible motion transmitting core element slidably supported in said conduit and operatively connecting said rear latch means;

a crank bar pivotally supported in said door and operatively interconnecting said core element with each of said interior and exterior actuator handles;

an interior lock button movably extending from said interior surface and operatively connected to said crank bar to move said crank bar out of operative engagement with said interior and exterior actuator handles; and an exterior lock cylinder movably extending from said exterior surface and operatively connected to said crank bar to move said crank bar out of operative engagement with said interior and exterior actuator handles.

3. A modular latch actuator assembly for actuating the rear latch mechanism of a sliding van door, said assembly comprising:

a mounting plate adapted for disposition within a sliding van door;

an interior actuator handle movably disposed on said mounting plate;

a crank bar pivotally supported on said mounting plate and operatively connected to said interior actuator handle;

an interior lock button movably supported on said mounting plate and operatively connected to said crank bar to move said crank bar out of operative engagement with said interior actuator handle; and a lost motion fitting extending from said crank bar for connecting an exterior lock cylinder.

4. A modular latch actuator assembly for actuating the rear latch mechanism of a sliding van door, said assembly comprising:

a mounting plate adapted for disposition within a sliding van door;

an interior actuator handle movably disposed on said mounting plate;

a crank bar pivotally supported on said mounting plate and operatively connected to said interior actuator handle;

an interior lock button movably supported on said mounting plate and operatively connected to said crank bar to move said crank bar out of operative engagement with said interior actuator handle;

a lost motion fitting extending from said crank bar for connecting an exterior lock cylinder; and roller latch release means pivotally supported on said mounting plate and operatively connected to said interior actuator handle independently of said crank bar for releasing a remote roller latch upon actuation of said interior actuator handles.

* * * * *